US006428946B2

(12) United States Patent
Buongiorne et al.

(10) Patent No.: US 6,428,946 B2
(45) Date of Patent: Aug. 6, 2002

(54) MULTI-PART PHOTOGRAPHIC COLOR DEVELOPING COMPOSITION AND METHODS OF MANUFACTURE AND USE

(75) Inventors: Jean M. Buongiorne, Brockport; Charles M. Darmon, Spencerport; Michael J. Haight; Erika S. McLarney, both of Rochester; Barry C. Kocher, Hilton; Sheridan E. Vincent; Charles S. Christ, Jr., both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/851,890

(22) Filed: May 9, 2001

Related U.S. Application Data

(62) Division of application No. 09/586,240, filed on Jun. 2, 2000, which is a division of application No. 09/506,944, filed on Feb. 18, 2000, now Pat. No. 6,136,518.

(51) Int. Cl.[7] ..... G03C 7/413
(52) U.S. Cl. ..... 430/450
(58) Field of Search ..... 430/450

(56) References Cited

U.S. PATENT DOCUMENTS

| | | | | |
|---|---|---|---|---|
| 4,232,113 | A | 11/1980 | Marchsano | 430/450 |
| 4,501,812 | A | 2/1985 | Marchesano | 430/466 |
| 4,873,180 | A | 10/1989 | Marchesano et al. | 430/491 |
| 4,876,174 | A | 10/1989 | Ishikawa et al. | 430/380 |
| 4,892,804 | A | 1/1990 | Vincent et al. | 430/380 |
| 5,354,646 | A | 10/1994 | Kobayashi et al. | 430/372 |
| 5,577,614 | A | 11/1996 | Palmeroni, Jr. et al. | 206/521 |
| 5,660,974 | A | 8/1997 | Marrese et al. | 430/490 |
| 6,010,835 | A | 1/2000 | Thomas et al. | 430/466 |
| 6,017,687 | A | 1/2000 | Darmon et al. | 430/490 |
| 6,037,111 | A | 3/2000 | Haye et al. | 430/491 |
| 6,077,651 | A | 6/2000 | Darmon et al. | 430/466 |
| 6,159,670 | A | 12/2000 | Buongiorne et al. | 430/491 |

*Primary Examiner*—Hoa Van Le
(74) *Attorney, Agent, or Firm*—J. Lanny Tucker

(57) ABSTRACT

A multi-part color developing kit includes at least two parts (or solutions) of photochemical compositions that can be mixed to provide a color developing composition useful for obtaining color photographic images. A first aqueous solution is formulated with a color developing agent in free base form, an antioxidant for the color developing agent, an inorganic base, a triazinylstilbene optical brightening agent, an chemical base and a water-miscible or water-soluble hydroxy-substituted, straight-chain organic solvent. A second aqueous solution is formulated with a buffering agent, the same or different chemical base and a phosphonic acid metal ion sequestering agent. Both solutions have a pH and homogeneity to provide a clear color developing composition that is safer for use and disposal.

19 Claims, No Drawings

MULTI-PART PHOTOGRAPHIC COLOR DEVELOPING COMPOSITION AND METHODS OF MANUFACTURE AND USE

CROSS-REFERENCE TO RELATED APPLICATION

This is a Divisional of U.S. Ser. No. 09/586,240 filed Jun. 2, 2000 which in turn, is a divisional of U.S. Ser. No. 09/506,944 filed Feb. 18, 2000, now U.S. Pat. No. 6,136, 518.

COPENDING APPLICATION

Copending and commonly assigned U.S. Ser. No. 09/132, 200 filed on Aug. 11, 1998 by Darmon et al.

Copending and commonly assigned U.S. Ser. No. 09/438, 121 filed on Nov. 10, 1999 by Haye et al.

FIELD OF THE INVENTION

The present invention relates to a multi-part photographic color developing composition having two or three separate solutions that can be mixed together prior to or during use. This invention also relates to a method of manufacturing this multi-part photographic color developing composition, and to a method for its use. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al) describes conventional color developing compositions that have found considerable commercial success in the photographic industry. Other known color developing compositions are described in U.S. Pat. No. 4,876,174 (Ishikawa et al), U.S. Pat. No. 5,354,646 (Kobayashi et al) and U.S. Pat. No. 5,660,974 (Marrese et al).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and additional water, a color developing composition can usually be obtained for use in the photographic processing machine.

It is generally known that the concentrations of various photochemicals and pH (typically alkaline) used in a photographic processing bath must lie within certain narrow limits in order to provide optimal performance. A relatively small change in any of the component concentrations or pH can diminish desired photochemical activity, storage stability, solution homogeneity, or any combination of these. Thus, each "part" or solution used to make a working strength solution must be formulated to provide a desired balance of all desired properties.

While multi-part color developing compositions are widely used in the photoprocessing industry (including in what are known as "minilabs"), they are sometimes supplied in containers that are not completely emptied during use. The residual solutions must therefore be discarded into the environment. In some countries, any of these solutions having extremely low or high pH are considered hazardous wastes and require more costly and tedious disposal procedures.

In addition, multi-part color developing compositions may also be corrosive to low carbon steel that may be present in photoprocessing equipment. This corrosivity may also be a result of extremely high or low pH.

To the unskilled person in the art, a simple solution to the problems would be to adjust pH so the solutions are no longer considered hazardous or corrosive. However, as pointed out above, this is not a simple matter and requires expert and complicated balancing of various components and pH to maintain stability and photochemical activity. As the number of "parts" and components in each increase, the number of possible modifications increases correspondingly, making it even harder to find the truly viable (that is commercial) options that will solve all of the problems simultaneously.

SUMMARY OF THE INVENTION

This invention provides an advance in the art by solving the problems noted above. In particular, the present invention provides a multi-part color developing kit comprising:

(I) a first solution having a pH of from about 7 to about 12.5 and comprising:
- (a) water,
- (b) a color developing agent in free base form, the color developing agent being present in the first solution in an amount of at least 0.05 mol/l,
- (c) at least 0.005 mol/l of an antioxidant for the color developing agent,
- (d) water-miscible or water-soluble hydroxy-containing, straight-chain organic solvent for the color developing agent in free base form, the organic solvent having a molecular weight of from about 50 to about 200,
- (e) at least 0.001 mol/l of a triazinylstilbene optical brightening agent, and
- (f) a first chemical base, (II) a second solution having a pH of from about 7 to about 12.5, and comprising:
- (a) water,
- (b) a buffering agent,
- (c) a second chemical base, and
- (d) at least 0.001 mol/l of a first phosphonic acid metal ion sequestering agent.

A method of making a multi-part color developing kit comprises:

(A) making a first solution to have a pH of from about 7 to about 12.5 by mixing in water, a color developing agent present as a sulfate salt, an antioxidant for the color developing agent, alkali metal ions in at least stoichiometric proportion to the sulfate salt, and a water-miscible or water-soluble hydroxy-containing, straight-chain organic solvent for the color developing agent in free base form, the organic solvent having a molecular weight of from about 50 to about 200, to form an alkali metal sulfate in the first solution, B) removing the alkali metal sulfate from the first solution, C) adding to the first solution a triazinylstilbene optical brightening agent, and (D) making an aqueous second solution to have a pH of from about 7 to about 12.5 of a buffering agent, a second chemical base, and at least one phosphonic acid metal ion sequestering agent.

This invention also provides a color developing composition obtained by mixing the first and second solutions described above in an approximate 1:1 volume ratio.

Further, this invention includes a method for providing a color image in a color silver halide photographic element comprising contacting the element with the color developing composition described above that is prepared from the multi-part color developing kit. This color developing step in a photographic processing method can be followed by desilvering the color photographic silver halide element, as well as any other useful photoprocessing steps known in the art.

The color developing kit of this invention can also be provided as part of a photographic processing chemical kit that includes one or more other photographic processing single-part or multi-part photochemical processing compositions. Such compositions can include, but not limited to, a photographic bleaching composition, a photographic bleach/fixing composition, a photographic fixing composition and a photographic stabilizing or final rinsing composition.

The color developing kit and composition of this invention have a number of advantages. In particular, the various solutions can be safely handled and disposed of because they are less hazardous than conventional solutions. The resulting color developing composition can be readily prepared by mixing the multiple solutions in a safe manner. In addition, the various "parts" are less corrosive to low carbon steels they may contact during use.

Formulating the first solution of the kit in a certain manner is also critical in order to prevent the formation of precipitates either in that solution or in the eventual color developing composition formed when all solutions are mixed. Thus, homogeneity is achieved by removing the sulfate ion with a mixing sequence that is an advance in the art, as described in copending U.S. Ser. No. 09/132,200 (noted above). The optical brightening agent is added at a critical point in formulation so that it will go into solution. Thus, each solution of the kit is formulated in a particular order to achieve the desired homogeneity and pH.

DETAILED DESCRIPTION OF THE INVENTION

The product obtained by the present invention is a multi-part color developing kit that can be used to provide color images in exposed color photographic silver halide elements. In this application, the terms "part" and "multi-part" are well understood in the photographic industry to refer to a "solution" or "multiple solutions", respectively. Generally, multi-part kits require two or more individual solutions to be mixed in a suitable fashion to provide the desired photoprocessing composition. Mixing can occur prior to or during use in the processing apparatus.

The color developing kit of the present invention comprises, at the very least, two solutions that include one or more chemicals useful in the photoprocessing procedures to obtain color images. In preferred embodiments, the kit includes three solutions that are mixed in a suitable fashion to make up a color developing composition. In addition, this kit can be included with other processing compositions (each in single- or multi-part format) as described below to provide a photoprocessing chemical kit.

The two ("first" and "second") essential solutions of the color developing kit of this invention can be formulated in the following manner.

The first solution includes a suitable color developing agent that is generally in the form of a sulfate salt. Other components of the first solution include an antioxidant for the color developing agent, a first chemical base (such as an alkali metal base) to adjust pH, a triazinylstilbene optical brightening agent, and a water-miscible or water-soluble hydroxy-containing organic solvent. This solvent is present in the first solution such that the molar ratio of the organic solvent(s) to the color developing agent(s) is from about 10:1 to about 30:1.

In this environment, especially at high alkalinity, alkali metal and sulfate ions form a water-insoluble sulfate salt that is precipitated in the presence of the hydroxy-containing organic solvent. The precipitated sulfate salt can then be readily removed using any suitable liquid/solid phase separation technique (including filtration, centrifugation or decantation) to provide a solution. If the antioxidant is a liquid organic compound, two phases may be formed and the precipitate may be removed by discarding the aqueous phase.

After removal of any precipitate, a triazinylstilbene optical brightening agent is mixed into the first solution in a suitable amount to make sure that is completely dissolved.

The second solution of the color developing kit is prepared by mixing a buffering agent, a second chemical base (that may be same or different from the first chemical base), and at least one phosphonic acid metal ion sequestering agent to the desired pH.

In a preferred embodiment, the kit can also include a third solution that can be merely water, or an aqueous solution of one or more of the components described for the second solution. It's pH is also maintained at from about 7 to about 12.5.

Thus, color developing compositions prepared using the kit of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to herein as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123,976 (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804 (Vincent et al), U.S. Pat. No. 4,876,174 (Ishikawa et al), U.S. Pat. No. 5,354,646 (Kobayashi et al) and U.S. Pat. No. 5,660,974 (Marrese et al), and U.S. Pat. No. 5,646,327 (Burns et al), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. One useful hydroxylamine antioxidant is N,N-diethylhydroxylamine.

In other embodiments, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the following Structure I:

I

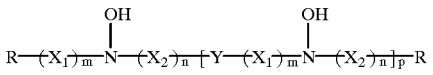

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred in this class of compounds.

It is particularly desirable to include a chemical base in one or more solutions of the color developing kit. Particularly useful chemical bases include inorganic bases such as alkali metal or ammonium hydroxides (for example sodium hydroxide or potassium hydroxide). Other useful chemical bases are alcoholamines (such as triethanolamine, and diethanolamine). The alkali metal hydroxides are most preferred for the first solution, and an alkali metal hydroxide or alcoholamine is useful in the second solution.

Another essential component of the first solution of the color developing kit of this invention is a water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

Preferably, such organic solvents are "photographically inactive" meaning that they provide no substantial positive or negative effect upon the color developing function of the composition at the concentration they are used.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol and triethylene glycol being most preferred. Of the alcohols, ethanol and benzyl alcohol are more preferred. The most preferred organic solvent is diethylene glycol.

Another component of the first solution one or more triazinylstilbene optical brightening agents. In some publications, triazinylstilbenes are identified as "triazylstilbenes". Preferably, the useful triazinylstilbenes are water-soluble or water-dispersible.

While not intending to be limiting in the definition of triazinylstilbenes useful in the practice of this invention, generally they can be represented by the following Structure II:

II

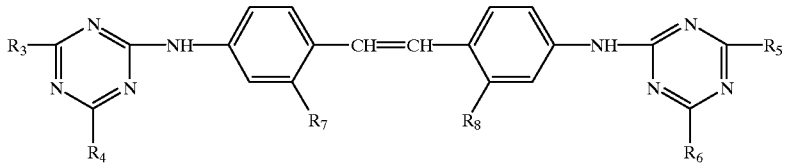

wherein $R_3$, $R_4$, $R_5$ and $R_6$ are independently hydroxy, halo (such as fluoro, chloro, bromo or iodo), a substituted or unsubstituted morpholino group, a substituted or unsubstituted aryl group generally having 6 to 10 carbon atoms in the carbocyclic ring (such as phenyl, a methoxyphenyl or a halophenyl), substituted or unsubstituted alkoxy group generally having a chain of from 1 to 10 carbon atoms that can be interrupted with one or more oxy, amino or carbonyl groups (such as methoxy, ethoxy, isopropoxy and t-butoxy), substituted or unsubstituted aryloxy group generally having from 6 to 10 carbon atoms in the carbocyclic ring (such as phenoxy or a chlorophenoxy), a substituted or unsubstituted alkyl group generally having from 1 to 10 carbon atoms (such as methyl, ethyl, isopropyl, t-butyl, n-hexyl, methoxymethyl, 2-chloroethyl and benzyl), an amino group (both cyclic and acyclic), an alkylamino group (both secondary and tertiary amines, each alkyl group as defined above) or an arylamino group (both secondary and tertiary, each aryl group as defined above. Preferably, $R_3$, $R_4$, $R_5$ and $R_6$ are independently an alkoxy group, an alkylamino group or an arylamino group, as defined above.

$R_7$ and $R_8$ are independently hydrogen or sulfo, provided at least one of $R_7$ and $R_8$ is sulfo. In preferred embodiments, each of these radicals is sulfo. The sulfo can be in free acid or salt form (sodium, potassium or ammonium salts).

Representative compounds within Structure II are shown in U.S. Pat. No. 4,232,112 (Kuse), U.S. Pat. No. 4,587,195 (Ishikawa et al), U.S. Pat. No. 4,900,651 (Ishikawa et al) and U.S. Pat. No. 5,043,253 (Ishikawa), all incorporated herein by reference with respect to such compounds. It is to be understood that at least some of these compounds can exist in various isomeric forms. Single isomers or mixtures thereof can also been used in the practice of this invention. The most preferred triazinylstilbene compounds (and isomers thereof) include the following Compounds A and B:

A

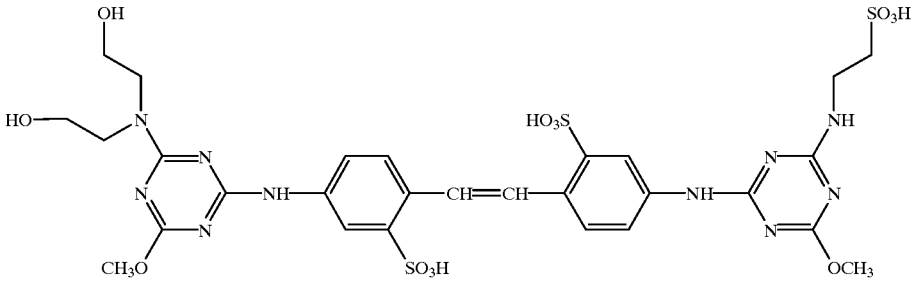

B

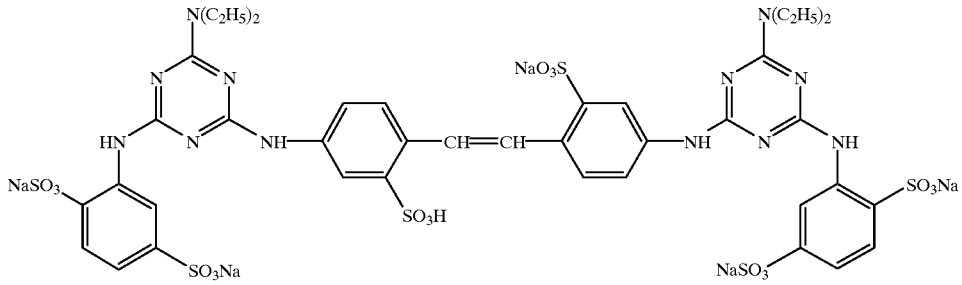

Compound A is most preferred, and is commercially available as BLANKOPHOR REU from Bayer. Compound B is commercially available as TINOPAL SFP from Ciba.

The second solution of the color developing kit includes one or more buffering agents are generally present in the color developing compositions of this invention to provide or maintain desired alkaline pH. These buffering agents are preferably soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

Phosphonic acid metal ion sequestering agents useful in the present invention are well known in the art, and are described for example in U.S. Pat. No. 4,596,765 (Kurematsu et al) and *Research Disclosure* publications 13410 (June, 1975), 18837 (December, 1979) and 20405 (April, 1981). Useful sequestering agents are readily available from a number of commercial sources. Particularly useful phosphonic acids are the diphosphonic acids (and salts thereof) and polyaminopolyphosphonic acids (and salts thereof) described below. It is preferable to use one or more compounds of these classes in combination. Useful diphosphonic acids include hydroxyalkylidene diphosphonic acids, aminodiphosphonic acids, amino-N,N-dimethylenephosphonic acids, and N-acyl aminodiphosphonic acids.

Prior to the formation of the second solution, one or more diphosphonic acids (described below) are preferably diluted in water so that the resulting solution of diphosphonic acid(s) has a pH of at least 6, and preferably at least 8. This diluted diphosphonic acid(s) can then be added to either the first or second solution in an appropriate manner. Preferably, the second solution is formed by adding the diluted diphosphonic acid to an aqueous solution of the buffering agent and polyaminopolyphosphonic acid. Alternatively, if the diphosphonic acid is used in the form of an alkali metal or ammonium salt, it may be added to the second solution at any time.

One useful class of diphosphonic acids includes hydroxyalkylidene diphosphonic acids (or salts thereof). Mixtures of such compounds can be used if desired. Useful salts include the ammonium and alkali metal ion salts. Preferred hydroxyalkylidene diphosphonic acids (or salts thereof) can be represented by the following Structure III:

III

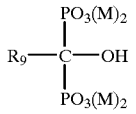

wherein $R_9$ is a substituted or unsubstituted alkyl group having 1 to 5 carbon atoms (methyl, methoxymethyl, ethyl, isopropyl, n-butyl, t-butyl and n-pentyl) and M is hydrogen or a monovalent cation (such as ammonium or alkali metal ions). Preferably, $R_9$ is methyl or ethyl, and most preferably, it is ethyl.

Representative sequestering agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST™ 2010. Its tetrasodium salt is available as DEQUEST™ 2016D. Both materials are available from Solutia Co.

Another useful disphosphonic acid is morpholinomethane-diphosphonic acid or a salt thereof.

A mixture of one or more diphosphonic acids can be used in the color developing composition of this invention if desired, in any desirable proportions.

Another preferred component of the second solution is a polyaminopolyphosphonic acid (or salt thereof) that has at least five phosphonic acid (or salt) groups. A mixture of such compounds can be used if desired. Suitable salts include ammonium and alkali metal (for example, sodium and potassium) ion salts. Such materials can be used as the only phosphonic acid in the second solution, but preferably they are used in combination with one or more diphosphonic acids are described above.

Preferred compounds of this nature can be represented by the following Structure IV:

IV

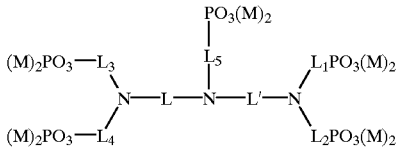

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing concentrates. Such substituents include, but are not limited to, hydroxy, sulfo, carboxy, halo, lower alkoxy (1 to 3 carbon atoms) or amino.

A particularly useful sequestering agent of this type is diethylene-triaminepentamethylenephosphosphonic acid or an alkali metal salt thereof (available as DEQUEST™ 2066 from Solutia Co.).

It is also possible to include other metal ion sequestering agents (for example, for iron, copper or manganese ion sequestration) in one or more of the solutions in the color developing kit.

The one or more solutions of the kit can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, wetting agents, fragrances, stain reducing agents, surfactants, defoaming agents, and water-soluble or water-dispersible color dye forming couplers, as would be readily understood by one skilled in the art [see for example, the *Research Disclosure* publications noted above]. The amounts of such additives would be well known to a skilled artisan in view of their usual concentrations in working strength compositions.

It may be desirable that no lithium or magnesium ions are purposely added to any of the solutions used to make up the color developing kit of this invention. In such situations, the total concentration (that is, the sum) of these ions remains preferably very low, that is less than 0.00001 mol/l in the final color developing composition (preferably less than 0.000001 mol/l).

The following TABLE I lists the general and preferred amounts of essential and some optional components of the first, second and optional third solutions forming the color developing kits of this invention. The preferred ranges are listed in parentheses (), and all of the ranges are considered to be approximate or "about" at the upper and lower end points.

TABLE I

| | |
|---|---|
| FIRST SOLUTION: | |
| pH | 7–12.5 (11.5–12.5) |
| Color developing agent(s) | 0.01–1 mol/l (0.04–0.4 mol/l) |
| Antioxidant(s) | 0.005–1 mol/l (0.05–1 mol/l) |
| Organic solvent to color developing agent(s) (molar ratio) | 10:1–30:1 (25:1–30:1) |
| Optical brightening agent(s) | 0.001–0.05 mol/l (0.005–0.02 mol/l) |
| First chemical base(s) | 0.1–5 mol/l (0.5–1.5 mol/l) |
| SECOND SOLUTION: | |
| pH | 7–12.5 (11.5–12.5) |
| First phosphonic acid sequestering agent(s) | 0.005–0.3 mol/l (0.01–0.1 mol/l) |
| Second phosphonic acid sequestering agent(s) | 0–0.3 mol/l (0.001–0.05 mol/l) |
| Buffering agent | 0.5–3 mol/l (1.5–2.5 mol/l) |
| Second chemical base(s) | 0.01–0.1 mol/l (0.07–0.09 mol/l) |
| THIRD SOLUTION: | |
| pH | 7–12.5 (11.5–12.5) |
| Phosphonic acid sequestering agent(s) | 0–0.1 mol/l (0–0.07 mol/l) |
| Buffering agent(s) | 1–5 mol/l (4–5 mol/l) |

In preferred embodiments of this invention, a multi-part color developing kit comprises the following three solutions:

(I) a first solution that is essentially free of sulfate, magnesium and lithium ions, has a pH of from about 11.5 to about 12.5 and comprises:
- (a) water,
- (b) CD-3 Color Developing Agent in free base form, the color developing agent being present in the first solution in an amount of from about 0.2 to about 0.4 mol/l,
- (c) from about 0.005 to about 1 mol/l of N,N-diethylhydroxylamine or N,N'-bis(2-methyl-2,3-dihydroxypropyl)hydroxylamine as an antioxidant for the color developing agent,
- (d) diethylene glycol, ethylene glycol or dipropylene glycol,
- (e) at least 0.005 mol/l of the Compound A triazinylstilbene optical brightening agent described above, and
- (f) an alkali metal hydroxide, (II) a second solution having a pH of from about 11.5 to about 12.5, and comprising:
- (a) water,
- (b) one or more carbonate buffering agents,
- (c) an alkali metal hydroxide or triethanolamine,
- (d) from about 0.01 to about 0.03 mol/l of diethylenetriaminepentamethylenephosphonic acid or a salt thereof, and
- (e) from about 0.005 to about 0.02 mol/l of either 1-hydroxyethylidene-1,1-diphosphonic acid or a salt thereof, or morpholinomethanediphosphonic acid or a salt thereof, and (III) a third solution having a pH of from about 11.5 to about 12.5 and comprising:
- (a) water, and
- (b) from about 0.01 to about 0.04 mol/l of either 1-hydroxyethylidene-1,1-diphosphonic acid or a salt thereof, or morpholinomethanediphosphonic acid or a salt thereof.

The multiple solutions of the color developing kit are mixed in a suitable fashion to form a color developing composition (either in concentrated or working strength form). Generally, the first and second solutions are mixed in an approximate 1:1 volume ratio, but this ratio can be varied ±20% if desired. Any additional solutions (such as water) can be added in a suitable volume to provide the desired dilution of active components. For example, the preferred three-part color developing kit described herein can be used to provide a color developing composition if the first, second and three solutions are mixed in an approximate 1:1:0.5 volume ratio (with ±20% variation in the ratio if desired).

The color developing compositions obtained from the kit of this invention have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above). In particular, the invention can be used to process color photographic papers of all types of emulsions including so-called "high chloride" and "low chloride" type emulsions, and so-called tabular grain emulsions as well. The color developing composition can also be used in processing of color reversal and color negative films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Representative commercial color papers that are useful in the practice of this invention include, but are not limited to, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK DURATRANS, KODAK DURACLEAR, KODAK EKTAMAX and KODAK DURAFLEX photographic materials and KODAK Digital Paper Type 2976 can also be processed using the present invention.

Color development of an imagewise exposed photographic silver halide element is carried out by contacting the element with a color developing composition prepared according to this invention under suitable time and temperature conditions, in suitable processing equipment, to produce the desired developed image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therein are well known for the various processing protocols including the conventional Process C-41 processing of color negative films, Process RA-4 for processing color papers and Process E-6 for processing color reversal films (see for example, *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 (noted above). Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The color developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using any suitable processing machine including those having deep tanks for holding processing solutions. Alternatively, it can be carried out using what is known in the art as "low volume thin tank" processing systems, or LVTT, which have either a rack and tank or automatic tray design. These processors are sometimes known as "minilab" processing machines. Such processing methods and equipment are described, for example, in U.S. Pat. No. 5,436,118 (Carli et al) and publications noted therein. Some useful minilab processing machines are commercially available as Noritsu 2211SM Printer/Paper Processor, Noritsu 2102SM Printer/Paper Processor and Noritsu 2301SM Printer/Paper Processor.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al). Useful fixing agents are also well known in the art and include various thiosulfates and thiocyanates or mixtures thereof.

The processing time and temperature used for each processing step of the present invention are generally those conventionally used in the art. For example, color development is generally carried out at a temperature of from about 20 to about 60° C. The overall color development time can be up to 40 minutes, and preferably from about 75 to about 450 seconds. The shorter overall color development times are desired for processing color photographic papers.

The color developing kit can be included in larger photoprocessing kit that includes one or more other photographic processing compositions (dry or liquid) including, but not limited to, a photographic bleaching composition, a photographic bleach/fixing composition, a photographic fixing composition, and a photographic dye stabilizing or rinsing composition. Such additional compositions can be formulated in concentrated or working strength solutions, or provided in dry form (for example, as a powder or tablet). Other processing compositions that can be included in such kits for either black and white or color photographic processing are reversal compositions, conditioning compositions, prebleach compositions, acidic stop compositions, and others readily apparent to one skilled in the photographic art. The processing kits can also include various processing equipment, metering devices, processing instructions, silver recovery devices and other conventional materials as would be readily apparent to one skilled in the art.

The various solutions of the color developing kit (and any other desired photoprocessing compositions) can be provided in various packaged forms and/or containers. They can be provided in bottles, drums, flexible containers (for example, what are known as "cubitainers" or "bag-in-a-box"), vials, packets or any other suitable container. The volumes for each solution can be the same or different. The containers can also be packaged together in a suitable manner for ease of shipping, use and disposal.

In one embodiment, the first, second and third solutions described above for the kit of this invention are provided in individual flexible (or collapsible) containers having some type of dispensing means (or conduit). Such embodiments are described in detail in U.S. Pat. No. 5,577,614 (Palmeroni, Jr. et al), incorporated herein by reference. In such embodiments, the flexible containers (or various sizes) are packaged together in a package that is designed for both shipping and solution dispensing, such as in a minilab processing machine. For example, the dispensing conduits of the flexible containers are designed for mating with valves and other connectors in the minilab processing machines.

The following examples are provided to illustrate the practice of this invention and not to limit it in any way. Unless otherwise indicated, percentages are by weight.

EXAMPLE 1

Three-Part Color Developing Kit

A most preferred color developing kit of this invention was formulated in the following manner:

A "first" solution was prepared by adding sodium hydroxide (50% solution, 81 g) to a solution of 4-(N-ethyl-N-2-methanesulfonylaminoethyl)-2-methylphenylenediamine sesquisulfate (CD-3 Color Developing Agent, 140 g) and N,N-diethylhydroxylamine antioxidant (30 g) in water (100 g). Because the antioxidant is an organic liquid, two phases resulted. With stirring, diethylene glycol (690 g) was then added and a precipitate of sodium sulfate was observed. This precipitate was filtered out of the solution, washed with 200 g of diethylene glycol that was then added to the solution, and the precipitate was discarded.

The triazinylstilbene optical brightener BLANKOPHOR REU 180 (10.6 g, Bayer) was then added to the first solution. Its pH was adjusted to 12.4 with sodium hydroxide. The solution was brought to a final volume of 1000 ml with diethylene glycol.

A "second" solution was prepared by adding a solution of potassium carbonate (593 g, 47.5%) buffering agent and diethylenetriamine-pentamethylenephosphonic acid (57.8 g, 25%, DEQUEST™ 2066 from Solutia Co.) to water (552 g). Triethanolamine (21.2 g, 85%) was then added, and the pH was adjusted to 12.4 with potassium hydroxide. The final volume of the second solution was 1000 ml.

A "third" solution for the color developing kit was provided by dissolving 1-hydroxyethylidene-1,1-diphosphonic acid (4.5 g, 60%, DEQUEST™ 2010 from Solutia Co.) to water (984 g). Potassium hydroxide was added to adjust the pH to 12.4.

Each of these three solutions was supplied in individual flexible plastic containers fitted with valves for connection and solution dispensing into SM processors (minilab processors). The plastic containers are packaged together in a commercial kit available from Eastman Kodak Company as EKTACOLOR/PI Catalog No. 1782713. Further details of these containers and packaging are provided in U.S. Pat. No. 5,577,614 (noted above).

EXAMPLE 2

Two-Part Color Developing Kit

An alternative color developing kit was prepared with only two separate solutions. The "first" solution was the same as that described in Example 1. The "second" solution was prepared by adding 1-hydroxyethylidene-1,1-diphosphonic acid (2.33 g, 60%, DEQUEST™ 2010 from Solutia Co.) to water (530.28 g). This solution was added to a solution of potassium carbonate (593.08 g, 47.5%) buffering agent and diethylenetriaminepentamethylenephosphonic acid (57.8 g, 25%, DEQUEST™ 2066 from Solutia Co.). Triethanolamine (42.4 g, 85%) was then added, and the pH was adjusted to 12.25 with potassium hydroxide. The final volume of the second solution was 1000 ml.

EXAMPLE 3

Color Developing Composition and Processing Method

The multi-part color developing kit described in Example 1 was attached to a commercially available SM processor and metered into a processing tank at the following volumes (at an approximate 1:1:10.5 volume ratio) and mixed with water (4.67 ml):

First solution: 0.51 ml.

Second solution: 0.54 ml.

Third solution: 0.28 ml.

The resulting composition was then used for color development in processing imagewise exposed samples of commercially available KODAK EKTACOLOR EDGE V Color Paper using a Noritsu commercial SM processor, and the following processing protocol and conditions to obtain acceptable color images:

| | | |
|---|---|---|
| Color Development | 38° C. | 25 seconds |
| Bleach/fixing | 35° C. | 25 seconds |
| Washing (water) | 35° C. | 90 seconds |

Bleach/fixing was carried out using commercially available EKTACOLOR SM Bleach Fix.

The invention has been described in detail with particular reference to preferred embodiments thereof, but it will be understood that variations and modifications can be effected within the spirit and scope of the invention.

We claim:

1. A method of making a multi-part color developing kit comprising:

A) making a first solution to have a pH of from about 7 to about 12.5 by mixing in water, a first chemical base, a color developing agent present as a sulfate salt, an antioxidant for said color developing agent, alkali metal ions in at least stoichiometric proportion to said sulfate salt, and a water-miscible or water-soluble hydroxy-containing, straight-chain organic solvent for said color developing agent in free base form, said organic solvent having a molecular weight of from about 50 to about 200, to form an alkali metal sulfate in said first part, B) removing the alkali metal sulfate from said first solution, and C) adding to said first solution a triazinylstilbene optical brightening agent, and D) making an aqueous second solution to have a pH of from about 7 to about 12.5 of a buffering agent, a second chemical base, and at least one phosphonic acid metal ion sequestering agent.

2. The method of claim 1 wherein a third solution is prepared by making an aqueous solution of any one or more components defined in said second solution, said third solution having a pH of from about 7 to about 12.5.

3. The method of claim 1 wherein said first solution has a pH of from about 11.5 to about 12.5, and said second solution has a pH of from about 11.5 to about 12.5.

4. The method of claim 1 wherein said color developing agent is present in said first solution in an amount of from about 0.04 to about 0.4 mol/l, said antioxidant is present in said first solution in an amount of from about 0.05 to about 1 mol/l, and the molar ratio of said organic solvent to said color developing agent in said first solution is from about 10:1 to about 30:1.

5. The method of claim 1 wherein said antioxidant is a hydroxylamine derivative having a solubilizing group.

6. The method of claim 5 wherein said antioxidant is represented by the structure I:

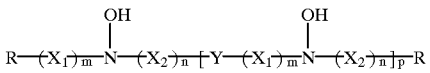

wherein R is hydrogen, an alkyl group, a hydroxyalkyl group, a cycloalkyl group or an aryl group, $R_1$ and $R_2$ are independently hydrogen, hydroxy, an alkyl group, or a hydroxyalkyl group, or $R_1$ and $R_2$ together represent the carbon atoms necessary to complete a 5- to 8-membered carbocyclic ring structure, $X_1$ is —$CR_2(OH)CHR_1$—, $X_2$ is —$CHR_1CR_2(OH)$—, and m, n and p are independently 0 or 1.

7. The method of claim 1 wherein said organic solvent is an alcohol or a glycol.

8. The method of claim 7 wherein said organic solvent is ethylene glycol, diethylene glycol, triethylene glycol, ethanol or benzyl alcohol.

9. The method of claim 1 wherein said first chemical base is an alkali metal hydroxide.

10. The method of claim 1 wherein said first phosphonic acid metal ion sequestering agent is a diphosphonic acid or a salt thereof.

11. The method of claim 1 wherein said first phosphonic acid metal ion sequestering agent is either a hydroxyalklidene diphosphonic acid or a salt thereof, or morpholinomethanediphosphonic acid or a salt thereof.

12. The method of claim 11 wherein said second solution further comprises at least 0.001 mol/l of a second phosphonic acid metal ion sequestering agent that is a polyaminopolyphosphonic acid or salt thereof having at least five phosphonic acid groups.

13. The method of claim 1 wherein neither said first solution nor said second solution comprises purposely added lithium or magnesium ions.

14. The method of claim 1 wherein said buffering agent is a carbonate.

15. The method of claim 2 wherein said third solution comprises water and at least one phosphonic acid metal ion sequestering agent.

16. The method of claim 15 wherein said third solution comprises 1-hydroxyethylidene-1,1-diphosphonic acid or a salt thereof, or morpholinomethanedisphosphonic acid or a salt thereof.

17. The method of claim 1 wherein an additional amount of said water-miscible or water-soluble hydroxy-containing, straight-chain organic solvent is added to said first solution after addition of said triazinylstilbene optical brightening agent.

18. The method of claim 1 wherein an additional amount of said water-miscible or water-soluble hydroxy-containing, straight-chain organic solvent is added to said first solution after removing said alkali metal sulfate and before addition of said triazinylstilbene optical brightening agent.

19. The method of claim 1 wherein said second solution further comprises a carbonate buffering agent, and said second chemical base is an alkali metal hydroxide.

* * * * *